United States Patent [19]

Yamazaki

[11] Patent Number: 5,060,605

[45] Date of Patent: Oct. 29, 1991

[54] VALVE DRIVE MECHANISM FOR VEHICLE ENGINE

[75] Inventor: Shojiro Yamazaki, Fujisawa, Japan

[73] Assignee: Isuzu Motors Limited, Tokyo, Japan

[21] Appl. No.: 543,591

[22] Filed: Jun. 26, 1990

[30] Foreign Application Priority Data

Jun. 26, 1989 [JP] Japan ..... 1-160730

[51] Int. Cl.[5] ..... F01L 1/26

[52] U.S. Cl. ..... 123/90.23; 123/90.27

[58] Field of Search ..... 123/90.22, 90.23, 90.27, 123/90.39, 90.4, 90.41, 90.44; 74/519, 559

[56] References Cited

U.S. PATENT DOCUMENTS

| | | | |
|---|---|---|---|
| 4,561,391 | 12/1985 | Simko | 123/90.27 |
| 4,649,874 | 3/1987 | Sonoda et al. | 123/90.23 |
| 4,732,119 | 3/1988 | Melde-Tuczai et al. | 123/90.23 |
| 4,773,360 | 9/1988 | Heimburg | 123/90.23 |
| 4,773,361 | 9/1988 | Toki et al. | 123/90.23 |
| 4,793,297 | 12/1988 | Fujii et al. | 123/90.23 |
| 4,796,574 | 1/1989 | Fujii et al. | 123/90.23 |

FOREIGN PATENT DOCUMENTS

| | | | |
|---|---|---|---|
| 0035106 | 2/1985 | Japan | 123/90.23 |
| 0178911 | 9/1985 | Japan | 123/90.23 |
| 0110864 | 4/1989 | Japan | 123/90.27 |

*Primary Examiner*—David A. Okonsky
*Attorney, Agent, or Firm*—Dykema Gossett

[57] ABSTRACT

A valve drive mechanism for driving intake and exhaust valves of a vehicle engine comprises a cam shaft offset toward the intake valve, a first rocker arm driven by the cam shaft for opening and closing the intake valve and a second rocker arm driven by the cam shaft via an intermediate rocker arm for opening and closing the exhaust valve. A spark plug can be disposed in an upright posture in a cylinder head since the cam shaft is offset and does not interfere with the location of the spark plug. It is possible to design a large-valve-face valve due to the upright posture of the spark plug. Also, each rocker arm is made to be lightweight, so that desired valve movement can be expected even when the engine revolution speed is high.

21 Claims, 6 Drawing Sheets

VALVE DRIVE MECHANISM FOR VEHICLE ENGINE

BACKGROUND OF THE INVENTION

1. Technical Field

The present invention relates to a valve drive mechanism to activate intake and exhaust valves disposed in a cylinder head of a vehicle engine.

2. Background Art

Generally a valve drive mechanism to drive intake and exhaust valves is provided at a top of a cylinder head of an engine. In some of the valve drive mechanisms of this type adapted to a four-cycle engine, particularly those designed for low-cost, high-output performance, one cam shaft is designed to drive at least three intake and exhaust valves (one intake valve and two exhaust valves or vice versa). Two examples of the valve drive mechanism for a so-called four-valve engine (four valves for each cylinder) is illustrated in FIGS. 8 to 10 of the accompanying drawings.

Referring first to FIG. 8 (in which only two valves are seen though, there are two more valves behind them, as illustrated in FIG. 9), a valve drive mechanism a has a cam shaft c journaled at the middle of a cylinder head b and a pair of rocker shafts d and e extending parallel to the cam shaft c at both sides of the cam shaft c, with four (only two are illustrated in FIG. 8) rocker arms f and g being rotatably supported by the respective rocker shafts d and e. One end of the rocker arm f contacts a cam h formed on the cam shaft c and the other end of the same contacts an intake valve j. Likewise, one end of the rocker arm g contacts another cam formed on the cam shaft c and the other end thereof contacts an exhaust valve k. These two intake valves j and two exhaust valves k are driven upon rotation of the cam shaft c.

FIG. 10 shows another valve drive mechanism m which has a cam shaft n located near the exhaust valve k in the cylinder head b. There is provided one rocker shaft 0 in the vicinity of the cam shaft n. Two relatively short rocker arms q (only one q is seen in FIG. 10) and two relatively long rocker arms p (only one p is seen in FIG. 10) are respectively and rotatably supported by the rocker shaft o. One end of the shorter rocker arm q contacts a cam r formed on the cam shaft n and the other end thereof contacts the exhaust valve k. Likewise, one end of the longer rocker arm p contacts another cam 5 and the other end thereof contacts the intake valve j. As the cam shaft n rotates, two intake valves and two exhaust valves k are respectively actuated.

Referring back to FIG. 8, since the cam shaft c of the valve drive mechanism a is located at the upper middle portion of the cylinder head b, the spark plug t has to be inclined in order to avoid interference between a spark plug t and the cam shaft c, and a large clearance is required between the intake valve j and exhaust valve k in order to ensure space for the spark plug t. Therefore, as shown in FIG. 9, the diameter I) of the face of the intake and exhaust valves j and k cannot be designed to be large. This becomes an obstacle to raising the output performance of the engine. Also, undesired combustion may takes place in the combustion chamber I due to the inclination of the spark plug t.

In the valve drive mechanism m of FIG. 10, it is possible to locate the spark plug t in an upright posture, as indicated by the broken line in the illustration, since the cam shaft n is offset toward the exhaust valve k. In this case, however, drive force from the cam s is transmitted to the intake valve via the longer rocker arm p. Therefore, the rocker arm p should be rigid, which makes the rocker arm p heavy. The inertia increases as the weight increases. This is not suitable for a high speed engine.

SUMMARY OF THE INVENTION

An object of the present invention is to provide a valve drive mechanism which allows the intake and exhaust valves to have large valve face area.

Another object of the present invention is to provide a valve drive mechanism which does not affect engine performance at high speed.

Still another object of the present invention is to provide a valve drive mechanism which has relatively small inertia.

According to one aspect of the present invention, there is provided a valve mechanism comprising: a cam shaft journaled in a cylinder head and being offset toward an intake valve (or an exhaust valve) such that a spark plug can be installed in an upright posture in the cylinder head; a first rocker arm driven by the cam shaft for opening and closing the intake valve; an intermediate rocker arm also driven by the cam shaft; and a second rocker arm driven by the intermediate rocker arm for opening and closing the exhaust valve (or intake valve). The first rocker arm is preferably supported by a first rocker shaft extending parallel to and relatively near the cam shaft. The intermediate rocker arm is also preferably supported by the first rocker arm. The second rocker arm is preferably supported by a second rocker shaft extending parallel to and relatively far from the cam shaft. All of the valves for one cylinder are driven upon rotation of a single cam shaft.

According to the valve drive mechanism of the present invention, since the spark plug can be disposed in the upright posture in the cylinder head, only a small clearance is necessary between the exhaust valve and intake valve and good combustion can be expected. Also, it is possible to design the intake and exhaust valves to have a large valve face area. Although the exhaust valve is relatively far from the cam shaft, the rocker arm means between the cam shaft and the exhaust valve can be made relatively light in weight since the rocker arm means is divided into two smaller pieces, i.e., the intermediate rocker arm and the second rocker arm, and total weight of these two pieces is smaller than a single large rocker arm illustrated in FIG. 10.

The valve drive mechanism of the present invention may be used in a so-called "two valve" engine (one intake valve and one exhaust valve for one cylinder) as well as in a so-called "four-valve" engine. In case of a four-valve engine, four cams (two intake cams and two exhaust cams) are formed on the cam shaft for each cylinder and two sets of first, intermediate and second rocker arms are provided for each cylinder. Where the cam shaft is positioned relatively near the intake valves, the exhaust cams are preferably formed to sandwich the intake cams are formed on the same cam shaft with respect to each cylinder. Due to this arrangement, the clearance between two intermediate rocker arms is large and the clearance between two second rocker arms is also large, which results in a large space above the center of the combustion chamber for the spark plug.

The intermediate rocker arm is preferably as light as possible in weight. Therefore, the intermediate rocker arm is preferably made from light alloy. However, it should be noted that one face of the intermediate rocker arm which contacts the exhaust cam and the other face which contacts the second rocker arm are preferably made from hard material such as chilled sintered alloy due to wear. The configuration of the intermediate rocker arm, in view of stiffness, is preferably such that the intermediate rocker arm has: two arm Portions; a portion supported by the rocker shaft, these two arm portions extending from the periphery of the supported portion in the radial direction of the first rocker shaft but in opposite directions; reinforcing members attached to the arm portions and on the supported portion respectively; a chip cam follower attached to one of the arm Portions; and a chip contact attached to the other arm portion.

The second rocker arm is preferably made from light weight alloy except one face of the second rocker arm which contacts the intermediate rocker arm and the other face which contacts the exhaust valve. These faces are preferably made from hard material such as hardenable casting iron. The rigidity, is preferably such that an arm portion of the intermediate rocker arm extends in the radial direction of the second rocker shaft from a periphery of a portion of the intermediate rocker arm which is supported by the rocker shaft, reinforcing member are attached to the arm portion and on the supported portion and a chip contact follower is attached to the arm portion.

Figure 8:
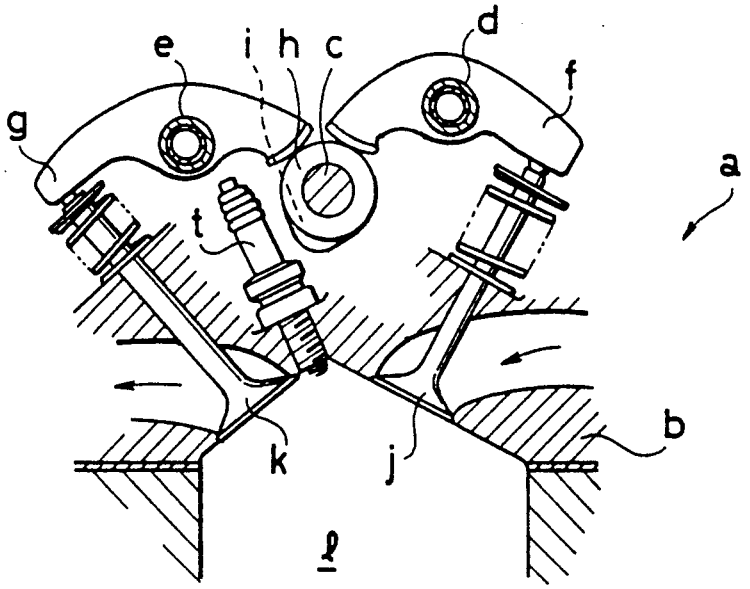
Figure 9:
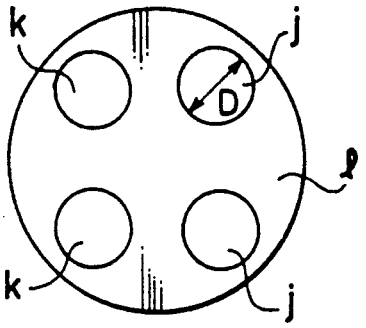
Figure 10:
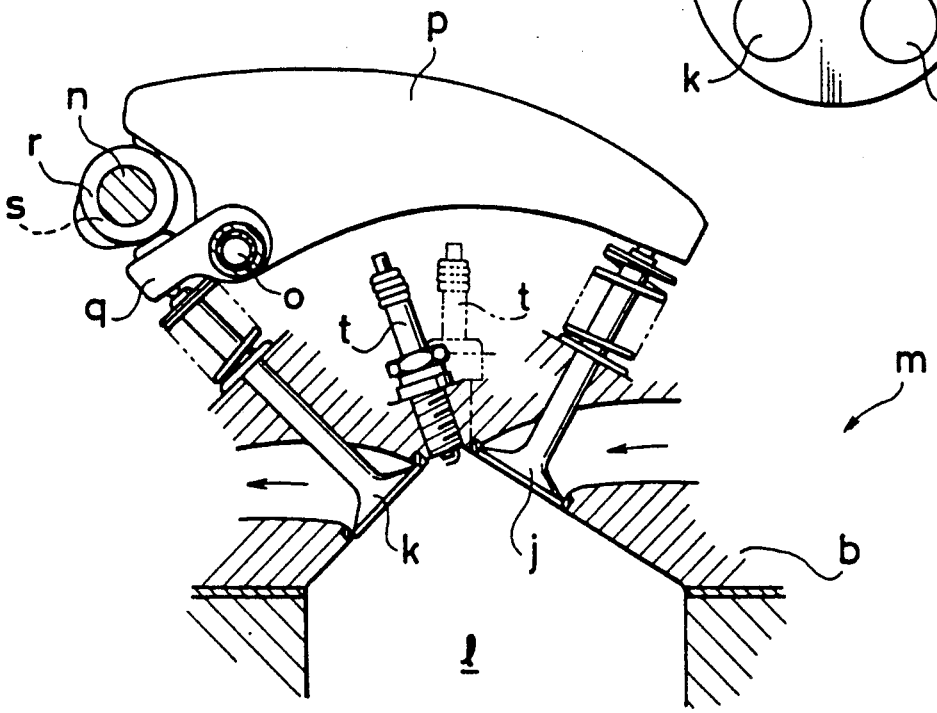

FIG. illustrates a perspective view of still another intermediate arm according to the present invention;

FIG. 8 shows a schematic sectional view of an engine having a conventional valve drive mechanism;

FIG. 9 is a view illustrating locations of the intake and exhaust valves of FIG. 8; and FIG. 10 shows another conventional valve mechanism installed in an engine.

DESCRIPTION OF THE PREFERRED EMBODIMENTS

A preferred embodiment of the present invention will now be explained.

Figure 1:
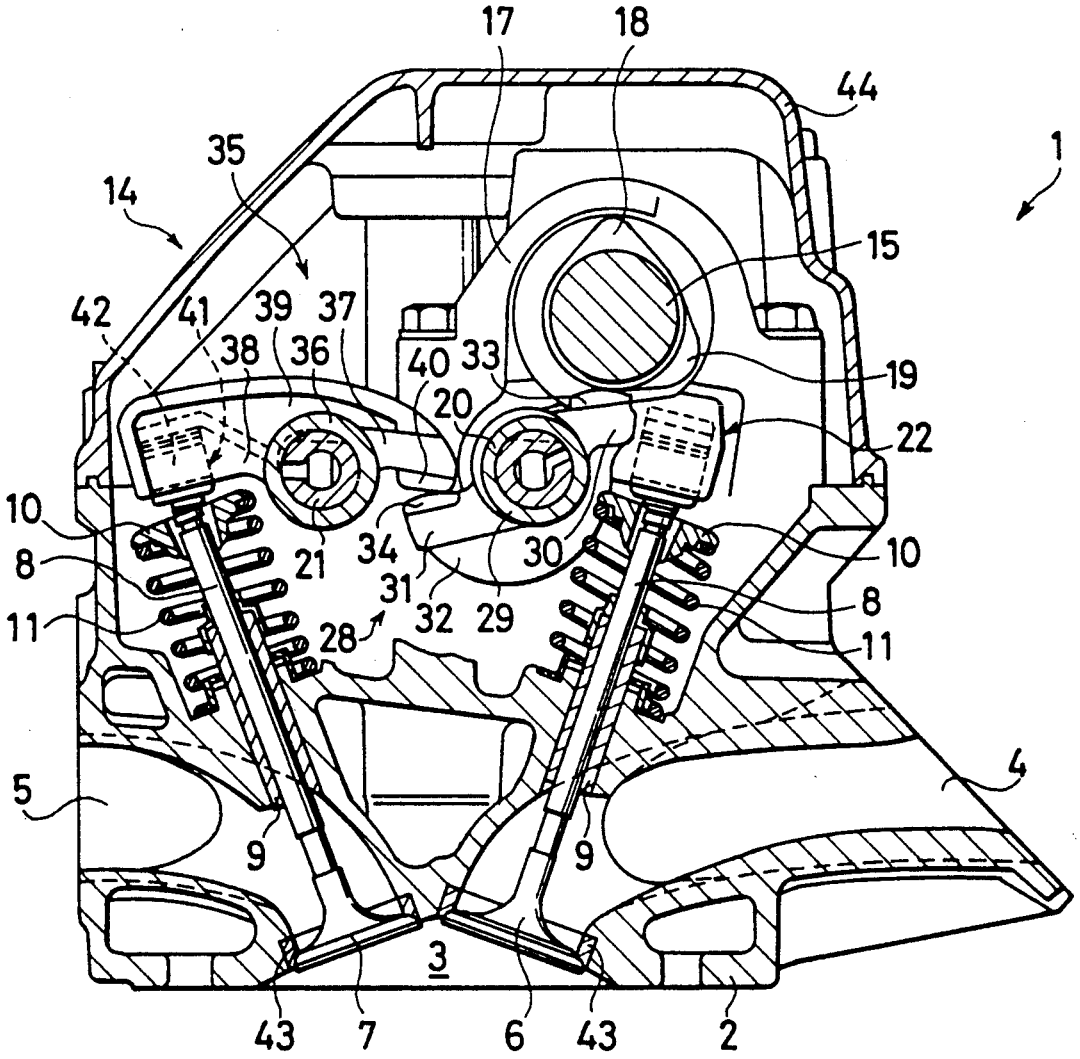
FIG. 1 is a sectional view showing a cylinder head provided with a valve drive mechanism of the present invention.
Figure 2:
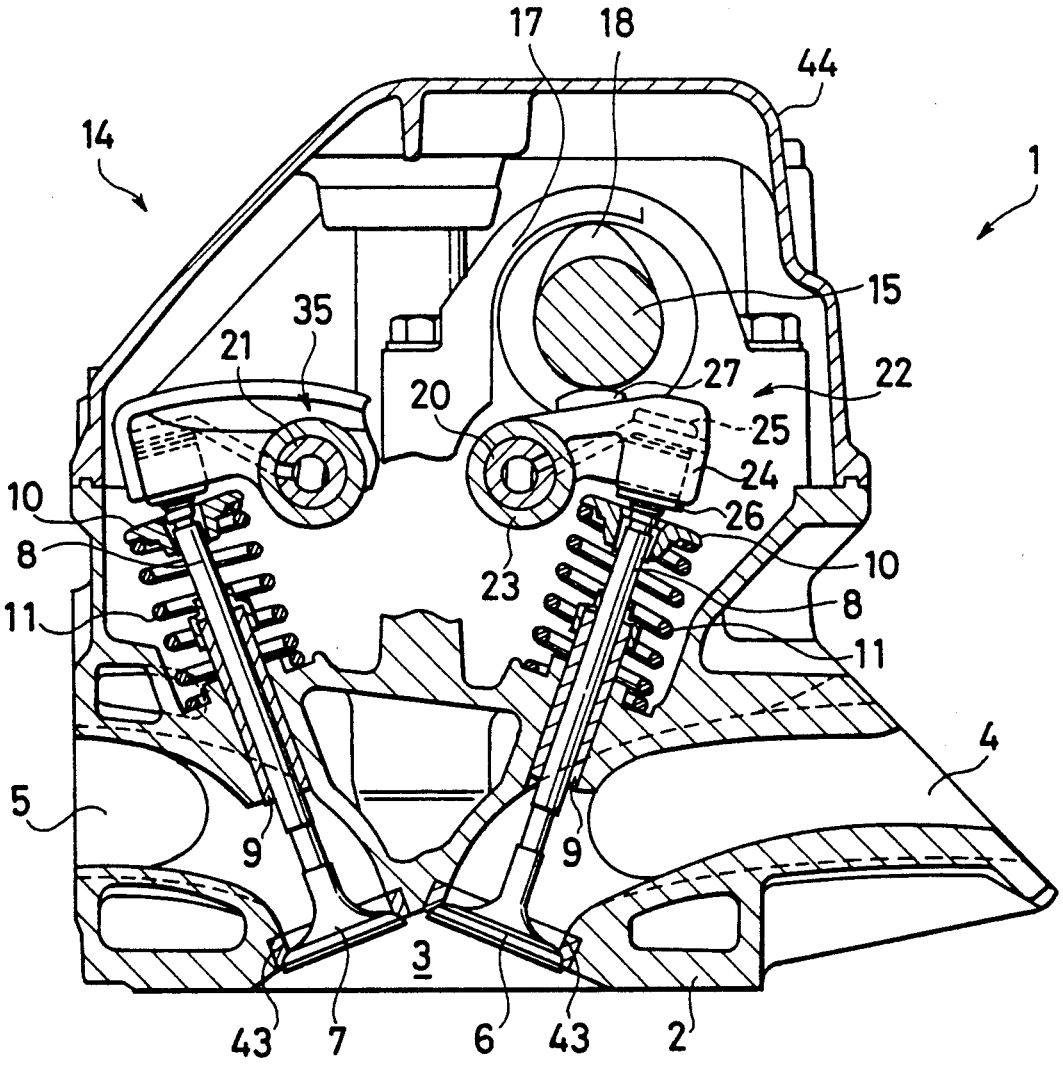
FIG. 2 is another sectional view of the cylinder head of FIG. 1.
Figure 3:
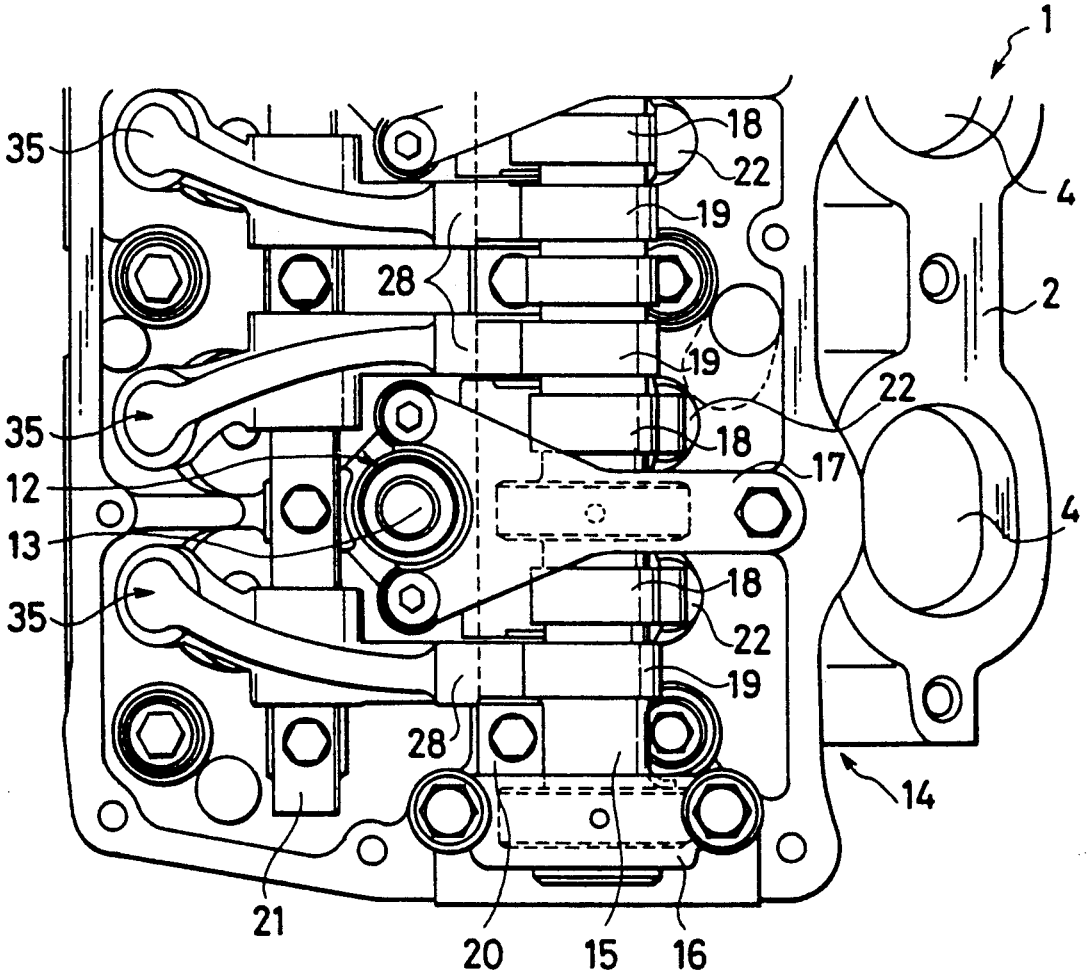
FIG. 3 is a top view showing the cylinder head of FIG. 1 as a cam cover is removed.

FIGS. 1 to 3 respectively illustrate a cylinder head 1 of a four-cylinder, sixteen-valve gasoline engine. Referring to FIGS. 1 and 2, the lower face of a main body 2 of the cylinder head 1 defines, with an inner face of a cylinder block (not shown) and a top face of a piston (not shown), a combustion chamber 3. Only one combustion chamber 3 is illustrated in the drawings, but there are three other combustion chambers aligned in a direction perpendicular to the drawing sheet.

In the main body 2 of the cylinder head 1, there are formed two intake ports 4 and two exhaust ports 5 for each combustion chamber 3 or for each cylinder The intake ports 4 extend in a direction perpendicular to the direction the four combustion chambers are aligned. Also, the intake ports are formed in a manner such that the intake ports communicates one lateral face (right side of the drawing) (not shown) of the cylinder head main body 2 with the combustion chamber 3. The exhaust ports 5 are disposed parallel to the intake ports and communicate the other lateral face (left side of the drawing) (not shown) of the cylinder head main body 2 with the combustion chamber 3.

Also, in the cylinder head main body 2, two intake valves 6 and two exhaust valves 7 are disposed for respective intake and exhaust ports 4 and 5. Each pair of intake and exhaust valves 6 and 7 are mounted to form a "V" shape by themselves in the plane of the drawing sheet. The intake and exhaust valves 6 and 7 respectively have valve stems 8 extending upwardly therefrom. The valve stems 8 are slidably mounted on the cylinder head by bushings 9 at the intermediate portions of the valve stems. Spring seats 10 are provided at the upper ends of the valve stems 8. Valve springs 11 are interposed between the lower end faces of valve seats 10 and the upper face of the cylinder head main body 2. In this manner, the intake and exhaust valves 6 and 7 are biased upward by the valve springs 11, thereby closing the intake and exhaust ports 4 and 5 of the combustion chamber 3.

Referring to FIG. 3, spark plug holes 12 are formed along the center line of the combustion chamber 3. The spark plug hole 12 extends from the top surface of the cylinder head main body 2 into the combustion chamber 3. Spark plugs 13 are threaded in the plug holes 12 and mounted on the cylinder head.

The cylinder head 1 further includes, as its major element, a valve drive mechanism 14. Specifically, a cam shaft 15 extends on or above the valve stems 8 in a direction parallel to the direction the four combustion chambers 3 extend. The cam shaft 15 is offset such that the cam shaft 15 does not interfere with the spark plug 13. The cam shaft 15 is driven by a crankshaft (not shown). The cam shaft 15 is rotatably supported by bearings 16 at either end thereof and are rotatably supported by other bearings 17 at intermediate portions thereof. Two intake cams 18 and two exhaust cams 19 are formed on the cam shaft 15 for each cylinder of the engine, with the two intake cams 18 being positioned to sandwich the intermediate bearing 17 and the two exhaust cams 19 being formed to sandwich the two intake cams 18. The intake cams 18 are located just above the valve stems 8 of the intake valves 6. As the cam shaft 15 rotates, the intake cams 18 and exhaust cams 19 respectively open and close the intake and exhaust valves.

As illustrated in FIG. 2, a first rocker shaft 20 and a second rocker shaft 21 extend parallel to each other and are provided below the cam shaft 15, on the exhaust valve 7 side. Two intake rocker arms 22, which are referred to as the first rocker arms, are pivotably mounted on the first rocker shaft 20, which is a rocker shaft closer to the cam shaft 15. The intake rocker arms 22 serve to transmit power from the intake cam 18 to the intake valve 6. For this purpose, the intake rocker arm 22 has a cylindrical supported portion 23 journaled on the first rocker shaft 20. An arm portion 24 protrudes from the periphery of the supported portion 23 in the radial direction of the first rocker shaft 20, with oil pressure tappets 26 being provided in a recess 25 formed at the free end of the arm portion 24 to create zero tappet clearance. Also, a chip cam follower 27 is provided at the approximate center of the arm portion 24. The arm portion 24 extends between the intake cam 18 and intake valve 6. The chip cam follower 27 and tappet 26 contact the periphery of the intake cam 18 and the top face of the valve stem 8 of the intake valve 6. The chip cam follower 27 is made from a chilled sintered alloy. The chip cam follower 27 is cast by aluminum alloy, thereby forming the support 23 and arm 24 into a single element.

Figure 4:
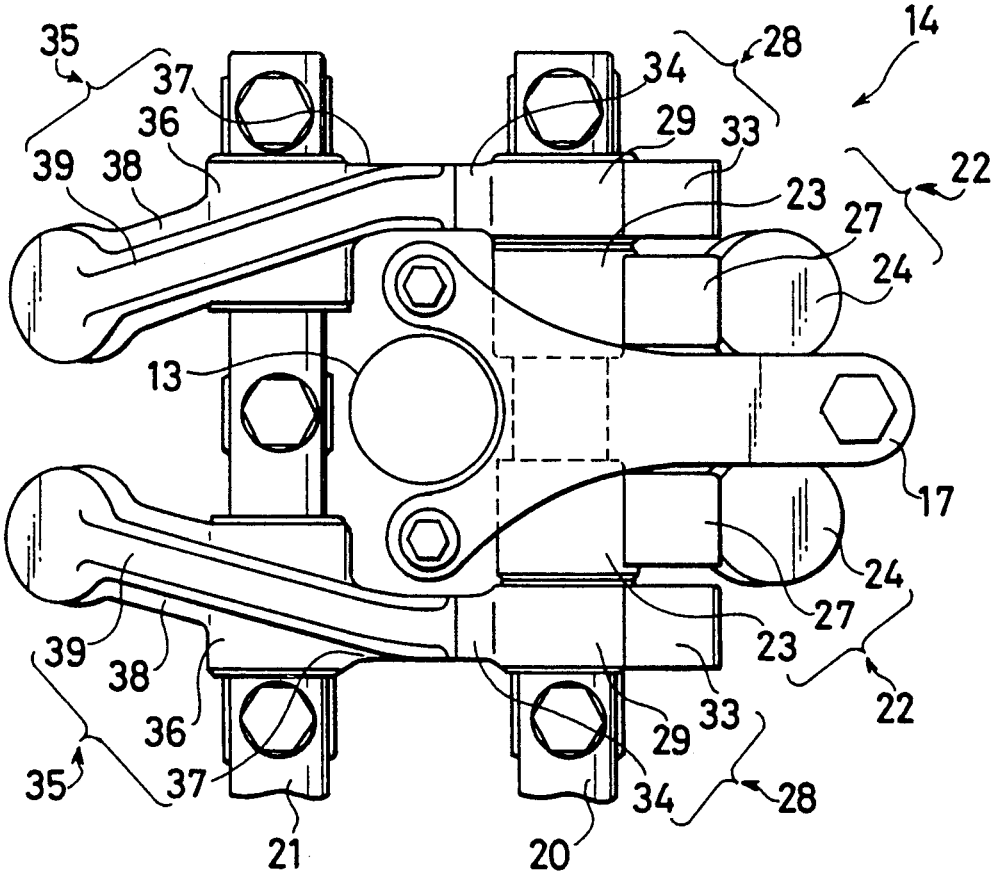
FIG. 4 is a fragmentary top view illustrating the valve drive mechanism of the present invention.

Referring now to FIG. 4, two first exhaust rocker arms 28, which are called intermediate rocker arms, are pivotably mounted on the first rocker shaft 20. The first exhaust rocker arms 28 are positioned outward, with the bearing 17 being a center, of the intake rocker arms 22. The first rocker arms 28 serve to transmit power from the exhaust cam 19 to a second exhaust rocker arm 35, which will be described later. For this purpose, the first exhaust rocker arms 28, as shown in FIG. 1, includes a cylindrical supported portion 29 rotatably supported on the first rocker shaft 20. Two arm portions 20 and 31 extend from the periphery of the supported portion 29 in the opposite directions and in the radial direction of the first rocker shaft 20. A reinforcement 32 is formed at a lower portion of the supported portion 29 and the arm portions 30 and 31. Chip cam follower 33 and chip contact 34 are respectively attached to free ends of the arms 30 and 31. The first exhaust rocker arm 28 is made by casting the chip contact 34 and chip cam follower 33 of chilled sintered alloy with aluminum alloy.

On the other hand, the second rocker shaft 21, i.e., the rocker shaft distal from the cam shaft 15, pivotably supports two second exhaust rocker arms 35. The second exhaust rocker arms 35 transmit power from the exhaust cams 19 to the exhaust valves 7 via the first rocker arms 28. For this purpose, a support 36 rotatably supported on the second rocker shaft 21 is formed in a cylindrical shape, and an arm portion 37 protrudes from the periphery of the supported portion 36 in the radial direction of the second rocker shaft 21. Another arm portion 38 extends from the periphery of the supported portion 36 in the opposite direction the arm portion 37 extends (FIG. 4). A reinforcement 39 is formed at the upper ends of the supported portion 36 and arm portions 37 and 38. A chip contact follower 40 is attached to the lower end of the arm 37. An oil pressure tappet 43 is disposed in a recess 41 formed at the free end of the arm 38. The arm 38 is inclined to let the lower end of the tappet 42 contact the upper end face of the valve stem 8 of the exhaust valve 7 when the chip contact follower 40 contacts the chip contact 34. By this construction, the chip contact follower 40 and tappet 42 respectively contact the chip contact 34 and the upper end face of the valve stem 8 of the exhaust valve 7. The chip contact follower 40 is made from hardenable casting iron. The chip contact follower 40 is cast using an aluminum alloy to form a single integral element of the supported portion 36, arm portions 37 and 38 and reinforcement 39. Meanwhile, in FIG. 1, the numeral 43 designates a valve seat and 44 designates a cam cover.

The operation of the valve drive mechanism 14 will be now explained.

A pair of intake valves 6 and a pair of exhaust valves 7 are forced by the respective valve springs 11 to close the intake and exhaust ports 4 and 5 of the combustion chamber 3. As the cam shaft 15 which is indirectly and drivingly connected to the crankshaft is rotated, a pair of intake cams 18 and a pair of exhaust cams 19 are rotated. When the chip cam followers 27 contact the Periphery of the intake cams 18 and the intake rocker arms 22 swing in accordance with the outer configuration of the intake cams 18 to press the intake valves 6, the valve stems 8 of the intake valves 6 are in turn forced against the valve springs 11, whereby the intake valves 6 are opened.

Upon the rotation of the cam shaft 15, the chip cam followers 33 contact the periphery of the exhaust cams 18 and the first exhaust rocker arms swing clockwise in FIG. 1 in line with the outer shape of the exhaust cam 19. Then, the chip contact followers 40 are forced upward by the chip contact 34, whereby the second exhaust rocker arms 35 are rotated counterclockwise. Thereupon, the valve stems 8 of the exhaust valves 7 are forced against the valve springs 11 to open the exhaust valves 7.

With continuous rotation of the cam shaft 15, when the chip cam followers 27 and 33 reach the basic circle of the non-circular intake and exhaust cams 18 and 19 respectively, the intake and exhaust valves 6 and 7 are closed again.

Figure 5:
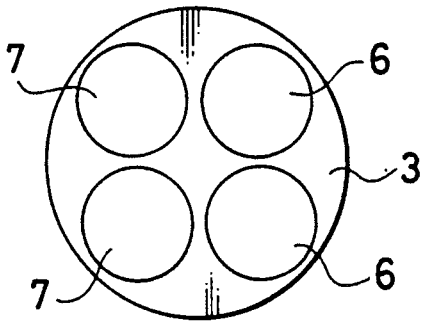
FIG. 5 shows an arrangement of intake and exhaust valves as the valve drive mechanism of the present invention is applied to the cylinder head.

Since the cam shaft 15 is rotatably supported above the valve stems 8 of the intake valves 6, the cam shaft 15 does not interfere with the location of the spark plugs 13. This makes the spark plug provision easier. Also, two pairs of first exhaust rocker arms 28 and second exhaust rocker arms 35, as shown in FIG. 4, surround the spark plug 13, thereby providing sufficient space for a mechanic to change the spark plug 13. Therefore, it is possible to bore the spark plug hole 12 along the center line of the combustion chamber 13. This means that the spark plug 13 can be mounted in a vertical or upright posture in the cylinder head main body 2. Accordingly, ideal provision of the intake and exhaust valves 6 and 7, as illustrated in FIG. 5, is realized. As a result, a large (larger than the conventional construction) valve area can be designed, while maintaining the manufacturing cost low and maintaining the output performance at the same level as a double-over-head-cam engine. In addition, a desired combustion can be expected since the spark plug 13 stands vertically in the cylinder head 2.

The valve drive power from the exhaust cam 19 is transmitted to the exhaust valves 7 via the first exhaust rocker arms 28 and the second exhaust rocker arms 35, so that it is possible to reduce the weight of the first and second exhaust rocker arms 28 and 35 and to drive the exhaust valves 19 in a desired manner even under high speed conditions. The rocker arms 28 and 35 are rigid, even though they are small, since they transmit power through rotation. When the first and second exhaust rocker arms are driven, a slip-and-rolling contact occurs at a contact face of the first and second exhaust rocker arms, but under actual conditions, the speed of slip or slide is very small, so that the opening and closing of the exhaust valves 7 are maintained smooth. Furthermore, the chip contact 34 and the chip contact follower 40, which are the contact portion of the first and second exhaust rocker arms 28 and 35, are both made from hard material, so that they can bear the friction and have a long life, while securing smooth slipping. Moreover, it is possible to reduce the force acting on the cam shaft 15 from the valve spring 11 by properly choosing a proper lever relation ratio between the rocker arms 28 and 35, which reduces the deflection of the cam shaft 15.

Figure 6:
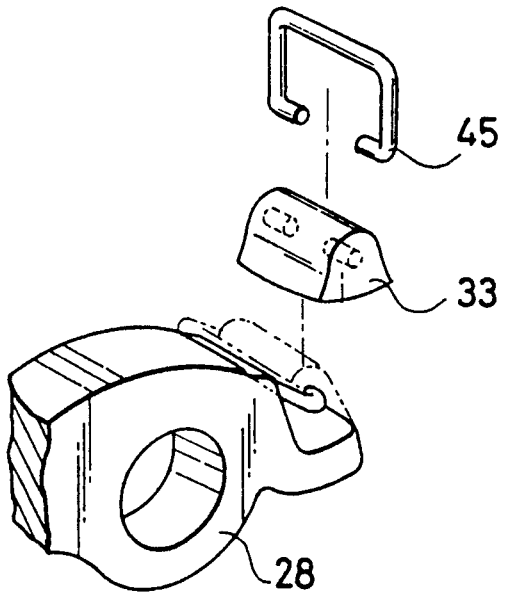
FIG. 6 is a perspective view of another intermediate rocker arm according to the present invention.
Figure 7:
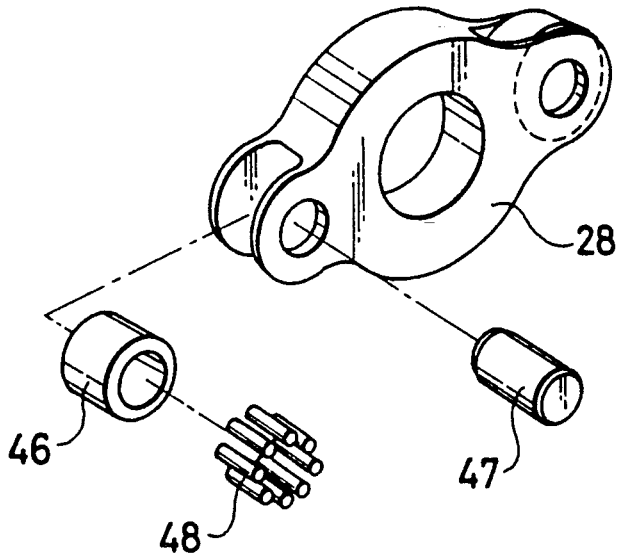

In the above embodiment, the cam shaft 15 is located close to the intake valves 6, but the cam shaft may be located near the exhaust valve 7 and the intake valves 6 may be driven via the intermediate rocker arms. Also, the chip cam followers 27, 33, the chip contact 34 and the chip contact follower 40 are cast with the intake rocker arms 22, the first and second exhaust rocker arms, but they may be detachable separate elements to be joined by another element 45, as shown in FIG. 6. In addition, a roller 46 may be employed instead of the chip cam follower 27 and 33, chip contact 34 and/or chip contact follower 40, as shown in FIG. 7. In FIG. 7, numeral 47 denotes a fixed shaft and 48 denotes roller bearings.

We claim:

1. A valve drive mechanism for an engine, the engine including at least one cylinder, at least one combustion chamber for each cylinder, a cylinder head, a spark plug for each cylinder, at least one intake valve for each cylinder, at least one exhaust valve for each cylinder, the cylinder having an axial direction and an upper portion, comprising:

a spark plug mounted in the axial direction of the cylinder;

a cam shaft journalled in the upper portion of the cylinder head, the cam shaft being offset toward the intake valve such that the cam shaft does not interfere with the spark plug;

a first rocker are swung by rotation of the cam shaft for opening and closing the intake valve, the first rocker arm directly contacting the cam shaft;

an intermediate rocker arm swung by the cam shaft, the intermediate rocker arm directly contacting the cam shaft; and a second rocker arm swung by the cam shaft via the intermediate rocker arm for opening and closing the exhaust valve, the second rocker arm directly contacting the intermediate rocker arm.

2. The valve drive mechanism of claim 1, wherein an intake cam and an exhaust cam are respectively formed on the cam shaft.

3. The valve drive mechanism of claim 2, further comprising:

a first rocker shaft spaced apart from the cam shaft by a predetermined distance, the first rocker shaft having a radial direction; and a second rocker shaft spaced apart from the cam shaft by a distance further than the predetermined distance, the second rocker shaft extending parallel to the first rocker shaft, the second rocker shaft having a radial direction, the intermediate rocker arm being swingably mounted on the first rocker shaft in a manner such that the intermediate rocker arm contacts the exhaust cam, the second rocker arm being swingably mounted on the second rocker shaft in a manner such that the second rocker arm contacts the intermediate rocker arm, the intermediate rocker arm having a radial direction.

4. The valve drive mechanism of claim 3, wherein the first rocker arm is swingably mounted on the first rocker shaft in a manner such that the first rocker arm contacts the intake cam.

5. The valve drive mechanism of claim 4, wherein two intake cams and two exhaust cams are formed on the cam shaft for each cylinder, two first rocker arms are provided, two intermediate rocker arms are provided and two second rocker arms are provided, such that two intake valves and two exhaust valves are opened and closed.

6. The valve drive mechanism of claim 5, wherein the two intake cams are formed between the two exhaust cams.

7. The valve drive mechanism of claim 6, wherein the cam shaft is rotatably supported by the cylinder at a portion of the cam shaft between the two intake cams.

8. The valve drive mechanism of claim 4, wherein a portion of the first rocker arm which contacts the intake cam is made from hard material whereas the other portion thereof is made from light weight alloy.

9. The valve drive mechanism of claim 8, wherein the hard material is chilled sintered alloy.

10. The valve drive mechanism of claim 4, wherein the first rocker arm includes:

a supported portion rotatably supported by the first rocker shaft, the supported portion including a periphery;

an arm portion protruding from the periphery of the supported portion in the radial direction of the first rocker shaft, the arm portion including an upper portion, a free end and a lower portion at the free end; and a chip cam follower portion attached to the arm portion such that the chip cam follower portion contacts the intake cam.

11. The valve drive mechanism of claim 10, further including an oil tappet provided at the lower portion of the free end of the arm portion, the tappet contacting the intake valve.

12. The valve drive mechanism of claim 10, wherein the arm portion extends between the intake cam and the intake valve and the cam chip follower portion is attached to the upper portion of the arm portion.

13. The valve drive mechanism of claim 3, wherein a portion of the intermediate rocker arm which contacts the exhaust cam is made from hard material and a portion of the intermediate rocker arm which contacts the second rocker arm is made from hard material whereas another portion thereof is made from light weight alloy.

14. The valve drive mechanism of claim 13, wherein the hard material is chilled sintered alloy.

15. The valve drive mechanism of claim 3, wherein the intermediate rocker arm includes:

a supported portion rotatably supported by the first rocker shaft, the supported portion including a periphery;

arm means protruding from the periphery of the supported portion in the radial direction of the first rocker shaft;

a first reinforcement portion attached to the arm means:

a second reinforcement portion attached to the supported portion;

a chip cam follower portion attached to the arm means such that the chip cam follower portion contacts the cam shaft; and a chip contact portion attached to the arm means such that the chip contact portion contacts the second rocker arm.

16. The valve drive mechanism of claim 15, wherein the arm means includes two arm portions extending in opposite directions from the periphery of the supported portion of the first rocker shaft, each arm portion having a free end, and the chip cam follower portion is attached to the free end of one of the arm portions and the chip contact portion is attached to the free end of the other arm portion.

17. The valve drive mechanism of claim 3, wherein a portion of the second rocker arm which contacts the intermediate rocker arm is made from hard material whereas the other portion thereof is made from light weight alloy.

18. The valve drive mechanism of claim 17, wherein the hard material is hardenable casting iron.

19. The valve drive mechanism of claim 3, wherein the second rocker arm includes:

a supported portion rotatably supported by the second rocker shaft, the supported portion including a periphery;

arm means protruding from the periphery of the supported portion in the radial direction of the second rocker shaft;

a first reinforcement portion attached to the arm means:

a second reinforcement portion attached to the supported portion; and a chip cam follower portion attached to the arm means such that the chip cam follower portion contacts the intermediate rocker arm.

20. The valve drive mechanism of claim 19, wherein the arm means includes two arm portions extending in opposite directions from the periphery of the supported portion of the second rocker arm, one of the arm portions having a free end and a lower portion at the free end, and the chip cam follower portion is the lower portion of the free end.

21. The valve drive mechanism of claim 19, further including an oil tappet provided at the lower portion of the free end of the arm portion, the tappet contacting the exhaust valve.

* * * * *